US012478831B1

(12) United States Patent
Blue, Jr.

(10) Patent No.: US 12,478,831 B1
(45) Date of Patent: Nov. 25, 2025

(54) BURPEE EXERCISE MACHINE

(71) Applicant: Anthony L. Blue, Jr., Memphis, TN (US)

(72) Inventor: Anthony L. Blue, Jr., Memphis, TN (US)

( * ) Notice: Subject to any disclaimer, the term of this patent is extended or adjusted under 35 U.S.C. 154(b) by 44 days.

(21) Appl. No.: 18/602,127

(22) Filed: Mar. 12, 2024

(51) Int. Cl.
*A63B 22/20* (2006.01)
*A63B 21/00* (2006.01)
*A63B 21/015* (2006.01)

(52) U.S. Cl.
CPC ..... *A63B 22/203* (2013.01); *A63B 21/00069* (2013.01); *A63B 21/015* (2013.01); *A63B 2208/0219* (2013.01)

(58) Field of Classification Search
CPC ..... A63B 22/203; A63B 21/00069; A63B 21/015; A63B 2208/0219
See application file for complete search history.

(56) References Cited

U.S. PATENT DOCUMENTS 4,948,121 A * 8/1990 Haaheim ..... A63B 22/0012 482/70
6,942,605 B1 * 9/2005 Sukhovitsky ..... A63B 23/0222 2/24
7,306,547 B2 12/2007 Stearns
7,455,633 B2 11/2008 Brown
7,780,585 B1 * 8/2010 Rivas ..... A63B 22/203 482/140
8,118,718 B2 2/2012 Brodess
8,137,250 B1 * 3/2012 Caban ..... A63B 23/0216 482/52
D660,383 S 5/2012 Watterson
12,053,664 B2 * 8/2024 Williams ..... A63B 21/4039
2004/0077468 A1 4/2004 Myles
2009/0018000 A1 * 1/2009 Brown ..... A63B 21/068 482/140
2010/0248919 A1 * 9/2010 Zhou ..... A63B 22/203 482/139
2011/0294631 A1 12/2011 Wu
2013/0337982 A1 * 12/2013 Williams ..... A63B 23/03525 482/122
2015/0065318 A1 * 3/2015 Lagree ..... A63B 22/203 482/130
2018/0169462 A1 * 6/2018 Jorstad ..... A63B 23/0205
2020/0001130 A1 * 1/2020 Schwarz ..... A63B 21/4034
2021/0086022 A1 * 3/2021 Williams ..... A63B 21/06
2022/0032106 A1 * 2/2022 Lagree ..... A63B 22/0087
2022/0176194 A1 * 6/2022 Barragan ..... A63B 21/4045

FOREIGN PATENT DOCUMENTS

WO 2008066559 6/2008

* cited by examiner

*Primary Examiner* — Andrew S Lo
(74) *Attorney, Agent, or Firm* — Kyle A. Fletcher, Esq.

(57) ABSTRACT

The burpee exercise machine includes a frame and two trolleys. The burpee exercise machine may be used to perform a beginner burpee exercise. The burpee exercise may be a modified form of a burpee exercise that may be well suited for individuals over 200 pounds in weight and/or over 6 ft in height. The burpee exercise machine may be adapted to work the abs and core. The frame may be positioned horizontally and may guide movement of the two trolleys. The two trolleys may slide longitudinally along the frame while a user's elbows and knees contact the two trolleys.

16 Claims, 4 Drawing Sheets

BURPEE EXERCISE MACHINE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of exercise equipment, more specifically, a beginner burpee exercise machine.

SUMMARY OF INVENTION

The burpee exercise machine comprises a frame and two trolleys. The burpee exercise machine may be adapted for a user to perform a beginner burpee exercise. The burpee exercise may be a modified form of a burpee exercise that may be well suited for individuals over 200 pounds in weight and/or over 6 ft in height. The burpee exercise machine may be adapted to work the abs and core. The frame may be positioned horizontally and may guide movement of the two trolleys. The two trolleys may be adapted to slide longitudinally along the frame while a user's elbows and knees contact the two trolleys.

An object of the invention is to provide exercise equipment for performing a beginner burpee exercise.

Another object of the invention is to provide a frame and two trolleys.

A further object of the invention is for a user to exercise on the invention by placing elbows on a first trolley and knees on a second trolley and by bending and straightening the upper legs and upper arms such that the distance between the two trolleys increases and decreases.

Yet another object of the invention is to provide a tension adjustment for each trolley.

These together with additional objects, features and advantages of the beginner burpee exercise machine will be readily apparent to those of ordinary skill in the art upon reading the following detailed description of the presently preferred, but nonetheless illustrative, embodiments when taken in conjunction with the accompanying drawings.

In this respect, before explaining the current embodiments of the beginner burpee exercise machine in detail, it is to be understood that the beginner burpee exercise machine is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the beginner burpee exercise machine.

It is therefore important that the claims be regarded as including such equivalent construction insofar as they do not depart from the spirit and scope of the beginner burpee exercise machine. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
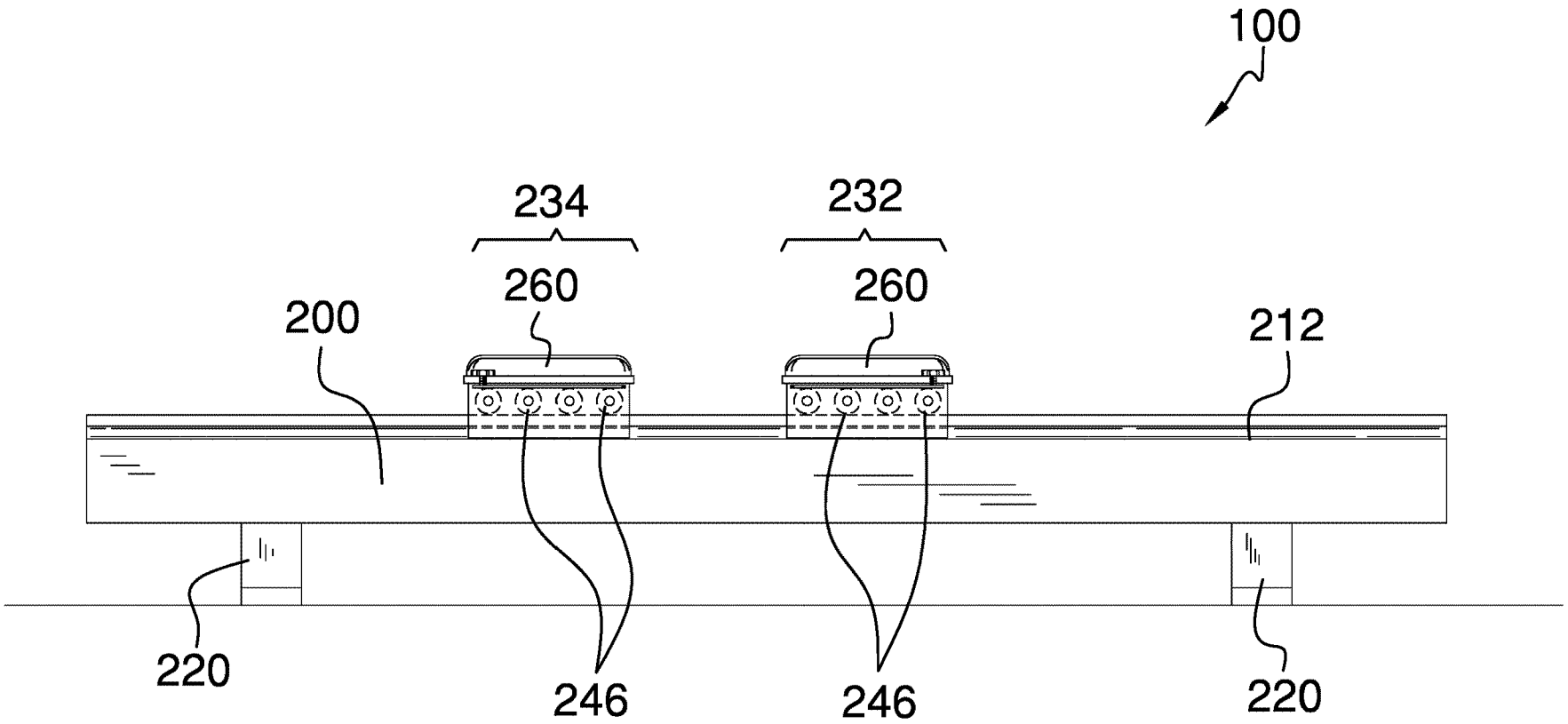
FIG. 1 is a side view of an embodiment of the disclosure.
Figure 2:
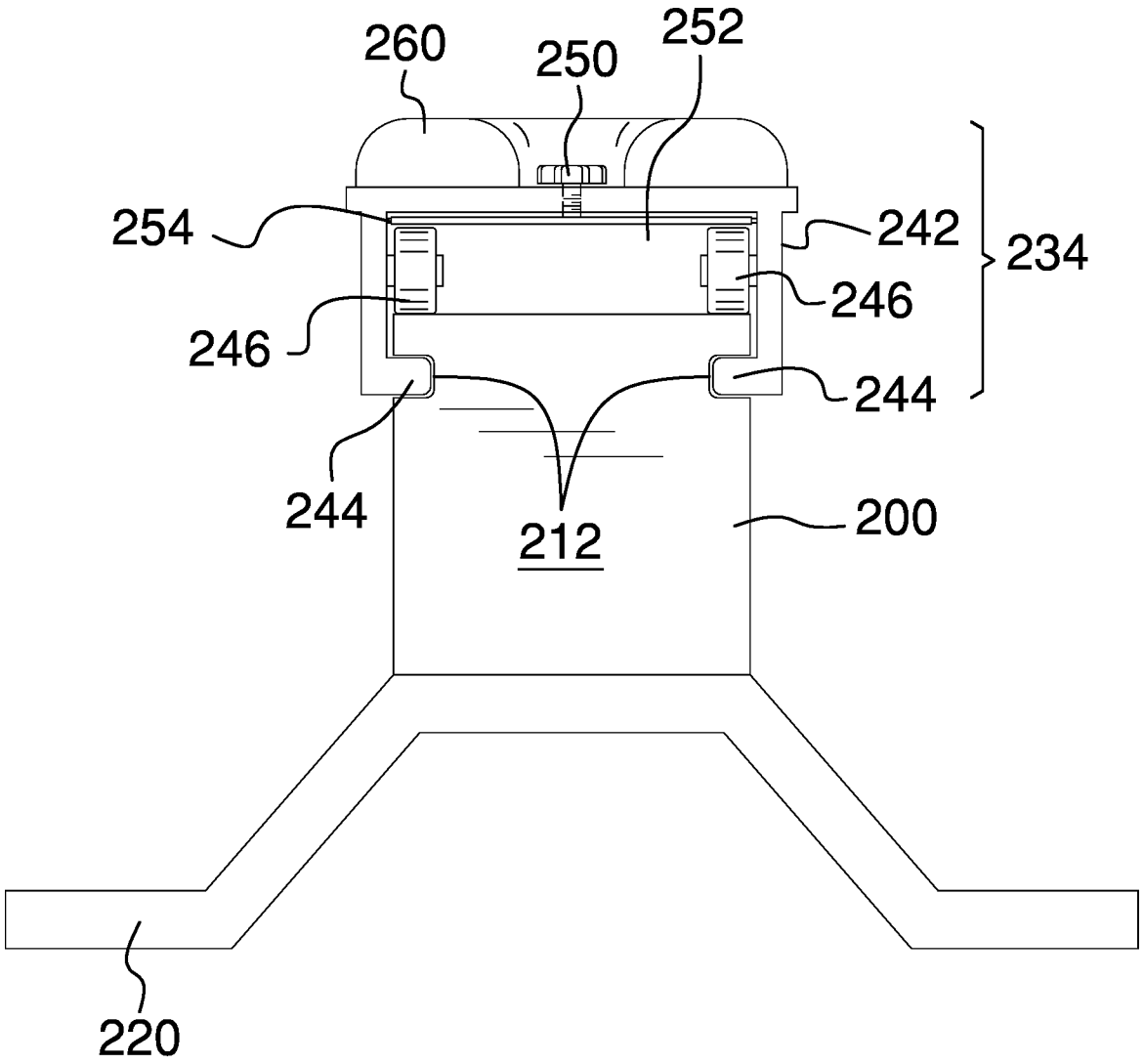
FIG. 2 is a front view of an embodiment of the disclosure.
Figure 3:
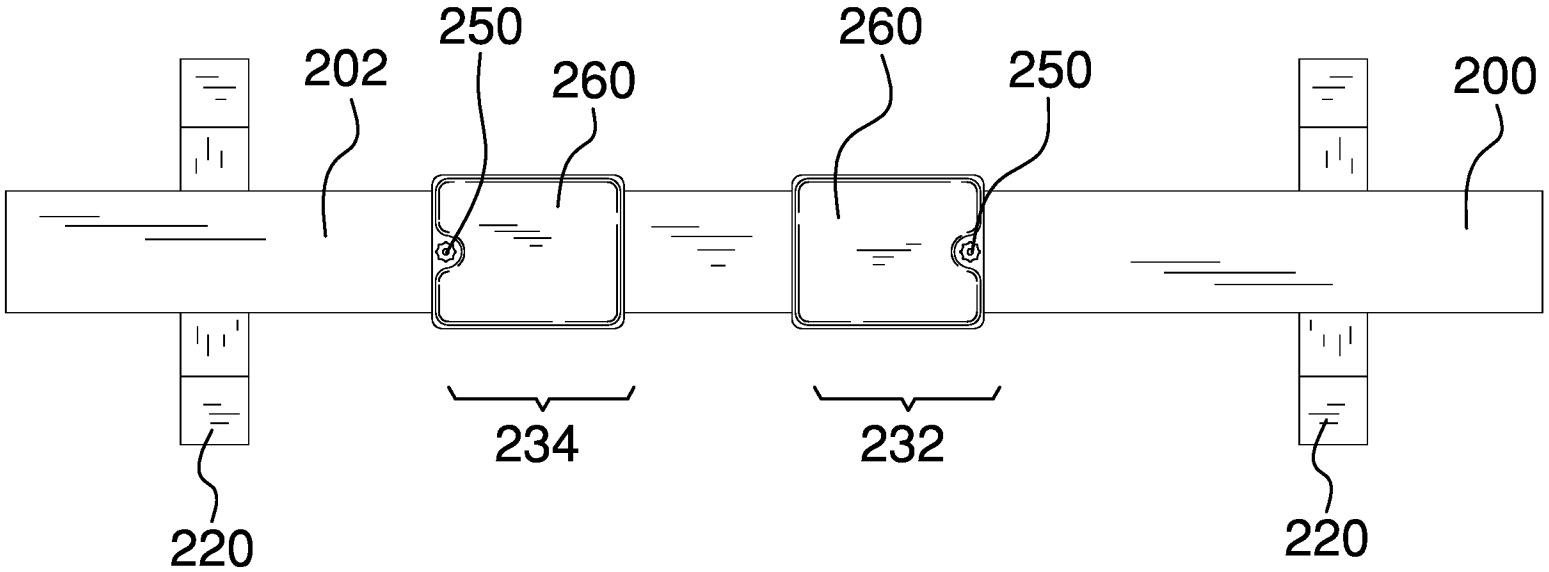
FIG. 3 is a top view of an embodiment of the disclosure.
Figure 4:
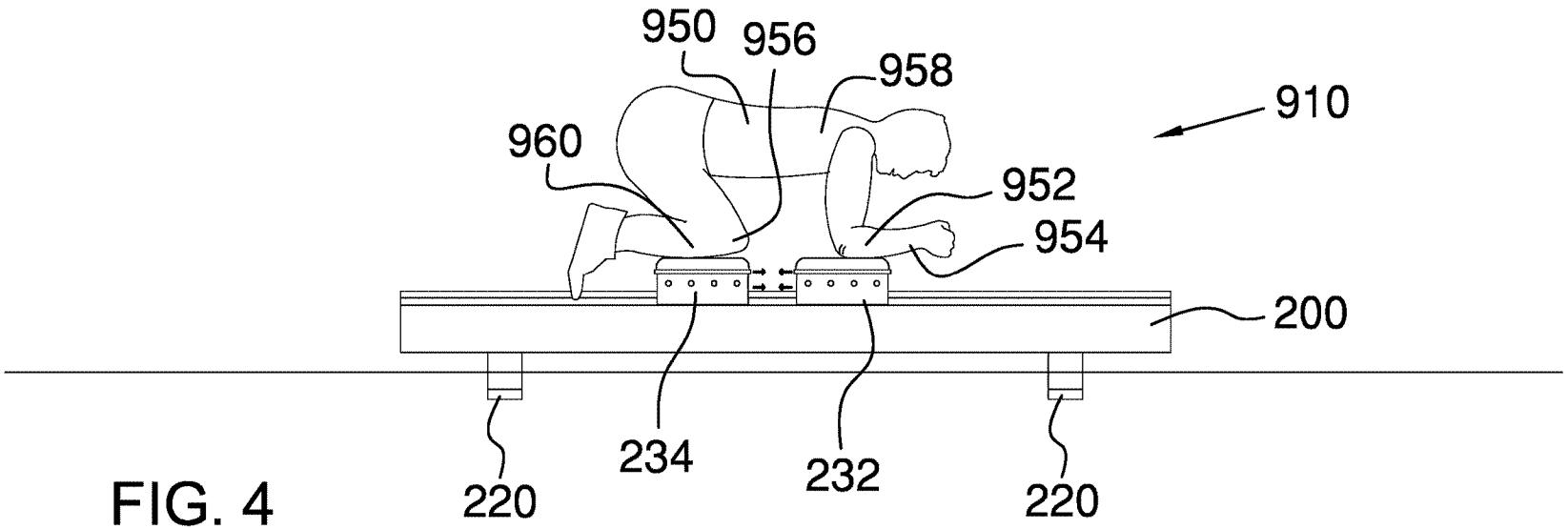
FIG. 4 is an in-use view of an embodiment of the disclosure, illustrating the knee elbow position.
Figure 5:
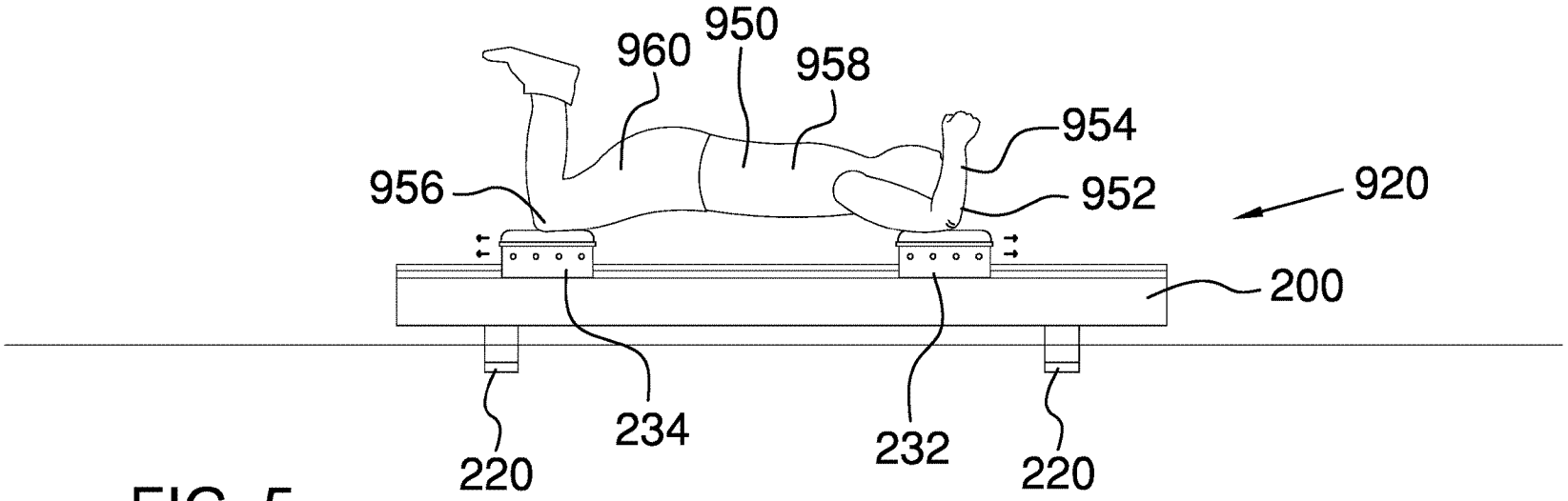
FIG. 5 is an in-use view of an embodiment of the disclosure, illustrating the modified prone position.

Detailed reference will now be made to a first potential embodiment of the disclosure, which is illustrated in FIGS. 1 through 5.

The beginner burpee exercise machine 100 (hereinafter invention) comprises a frame 200 and two trolleys. The invention 100 may be adapted for a user 950 to perform a beginner burpee exercise. The beginner burpee exercise may be a modified form of a burpee exercise that may be well suited for individuals over 200 pounds in weight and/or over 6 ft in height. The invention may be adapted to work the abs and core. The frame 200 may be positioned horizontally and may guide movement of the two trolleys. The two trolleys may be adapted to slide longitudinally along the frame 200 while a user's elbows 952 and knees 956 contact the two trolleys.

The frame 200 may be an elongated bar having a longitudinal length that is larger than the lateral width and vertical height. The two trolleys may slidably couple to the frame 200 and may move longitudinally along the frame 200. In a preferred embodiment, the longitudinal length of the frame 200 may be 5 feet to 6 feet and the lateral width of the frame 200 may be 2 feet or less.

The frame 200 may comprise a planar top surface 202. The planar top surface 202 may be configured for a plurality of rollers 246 located on each of the two trolleys to roll over.

The frame 200 comprise a track that may be operable to guide the two trolleys. The track may comprise retainer grooves 212 located on the sides of the frame 200. The retainer grooves 212 may be positioned on the top half of the sides such that the two trolleys may engage the retainer grooves 212 to hold the two trolleys down on the frame 200.

The frame 200 may be supported by a plurality of feet 220. The plurality of feet 220 may lift the frame 200 off of the floor to achieve a comfortable height for use and may widen the base of the invention 100 for stability.

The two trolleys may comprise a first trolley 232 and a second trolley 234. Through this document, the first trolley 232 will be treated as the front trolley located in the vicinity of the user's elbows 952 and the second trolley 234 will be treated as the rear trolley located in the vicinity of the knees 956. In reality, the first trolley 232 and the second trolley 234 are identical and the user 950 may assume either orientation with respect to the two trolleys.

An individual trolley selected from the first trolley 232 and the second trolley 234 may comprise a trolly armature 242, the plurality of rollers 246, and a pad 260. The trolly armature 242 may engage the retainer grooves 212 in the frame 200 and the plurality of rollers 246 may roll over the planar top surface 202 of the frame 200.

The trolly armature 242 may be an upside-down U-channel that covers the top of the frame 200 and extends down both sides of the frame 200 to the retainer grooves 212. The trolly armature 242 may comprise a plurality of retention fingers 244 at the bottom of the left side and right side of the trolly armature 242. The plurality of retention fingers 244 may project inward towards the center of the frame 200 such that the plurality of retention fingers 244 may engage the retainer grooves 212 on the frame 200. As a non-limiting example, the individual trolley may be coupled to the frame 200 by sliding the trolly armature 242 onto the end of the frame 200 while aligning the plurality of retention fingers 244 with the retainer grooves 212.

The plurality of rollers 246 may be coupled to the trolly armature 242 such that the individual trolley may roll over the planar top surface 202 of the frame 200. The plurality of rollers may be positioned under the top surface of the trolly armature 242 in a space between the planar top surface 202 of the frame 200 and the trolly armature 242. The plurality of rollers 246 may be rotationally coupled to the inside of the left and right side walls of the trolly armature 242. Each of the plurality of rollers 246 may have an axis of rotation that is laterally oriented and parallel to the planar top surface 202 of the frame 200.

The pad 260 may be coupled to the top of the trolly armature 242. The pad 260 may be adapted to cushion the top of the individual trolley for the comfort of the user 950.

The resistance between the frame 200 and the individual trolley may be adjustable such that the degree of difficulty required to move the individual trolley may be modified. As a non-limiting example, the individual trolley may comprise a tension adjustment knob 250 and a pressure plate 252. The pressure plate 252 may be pivotably coupled to the trolly armature 242 on the underside of the trolly armature 242. The tension adjustment knob 250 may be operable to pivot the pressure plate 252 around a pivot point 254. The tension adjustment knob 250 may be turned in a first rotational direction to pivot the pressure plate 252 downwards such that the pressure plate 252 presses against the plurality of rollers 246 to increase resistance to movement. The tension adjustment knob 250 may be turned in a second rotational direction that is opposite the first rotational direction to pivot the pressure plate 252 upwards such that the pressure plate 252 lifts away from the plurality of rollers 246 to decrease resistance to movement.

The invention 100 may be adapted for the user 950 to exercise on by following these steps:

- The user's elbows 952 may be placed on the pad 260 of the first trolley 232.
- The knees 956 may be placed on the pad 260 of the second trolley 234.
- The user 950 may assume a knee elbow position 910 by lifting the user's torso 958 above the pads 260 on the two trolleys using a user's arms 954 and upper legs 960. This position may also be referred to as a Burpee position.
- The user 950 may assume a modified prone position by straightening the body such that the distance between the first trolley 232 and the second trolley 234 increases.
- The user 950 may return to the knee elbow position 910 by pulling the first trolley 232 and the second trolley 234 together using core muscles.

The first trolley 232 or the second trolley 234 may be made immovable by increasing resistance using the tension adjustment knob 250.

In use, the frame 200 may be placed on a floor, resting on the plurality of feet 220, such that the planar top surface 202 is oriented horizontally. An individual trolley selected from the first trolley 232 and the second trolley 234 may be coupled to the frame 200 from either end of the frame 200 by aligning the plurality of retention fingers 244 on the trolly armature 242 with the retainer grooves 212 and sliding the individual trolley onto the frame 200. The tension adjustment knobs 250 on the first trolley 232 and the second trolley 234 may be adjusted to provide the desired amount of resistance to trolley movement. To exercise, the user's elbows 952 may be placed on the first trolley 232 and the knees 956 may be placed on the second trolley 234. The user 950 may then repeatedly transition between the knee elbow position 910 and the modified prone position 920 to strengthen the user's core.

DEFINITIONS

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "between" may refer to movement from a first endpoint to a second endpoint in either direction and specifically does not limit the direction of the movement. Alternatively, "between" may refer to a position bounded by two endpoints and, unless stated otherwise, may be inclusive of the endpoints. As used, herein, endpoints may comprise points on a number line, lines within a plane, and planes in a three-dimensional space.

As used herein, "burpee exercise" may refer to a full body exercise that may be used for strength training. A basic four-count burpee may comprise repeated transitions between a standing position, a squat, a plank, and another squat. Variations may include a jump during the standing position, a push-up during the plank position, or both.

As used herein, the words "couple", "couples", "coupled" or "coupling", may refer to connecting, either directly or indirectly, and does not necessarily imply a mechanical connection.

As used in this disclosure a "cushion" may be a pad or pillow formed from soft material that is used for resting, sleeping, sitting, or reclining.

As used herein, the word "desired" may refer to a specific value or action within a range of supported values or action. A "desired" value or action may indicate that a range of values or actions is enabled by the invention and that a user of the invention may select a specific value or action within the supported range of values or actions based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, the word "lateral" may refer to the sides of an object or movement towards a side. Lateral directions are generally perpendicular to longitudinal directions. "Laterally" may refer to movement in a lateral direction.

As used herein, the word "longitudinal" or "longitudinally" may refer to a lengthwise or longest direction or to a direction that is perpendicular to the lateral direction.

As used in this disclosure, "orientation" may refer to the positioning and/or angular alignment of a first object relative to a second object or relative to a reference position or reference direction.

As used herein, the word "pivot" may include any mechanical arrangement that allows for rotational motion. Non-limiting examples of pivots may include hinges, holes, posts, dowels, pins, points, rods, shafts, balls, and sockets, either individually or in combination.

As used herein, "prone" may refer to a horizontal position where the dorsal side is up and the ventral side is down and "supine" may refer to a horizontal position where the dorsal side is down and the ventral side is up. As non-limiting examples, a person lying on their stomach is in a prone position and a person lying on their back is in a supine position.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A beginner burpee exercise machine comprising:

a frame and two trolleys;

wherein the beginner burpee exercise machine is adapted for a user to perform a beginner burpee exercise;

wherein the beginner burpee exercise machine is adapted to work the abs and core;

wherein the frame is positioned horizontally and guides movement of the two trolleys;

wherein the two trolleys are adapted to slide longitudinally along the frame while a user's elbows and knees contact the two trolleys;

wherein the frame comprise a track that is operable to guide the two trolleys;

wherein the track comprises retainer grooves located on the sides of the frame;

wherein the retainer grooves are positioned on the top half of the sides such that the two trolleys engage the retainer grooves to hold the two trolleys down on the frame;

wherein an individual trolley selected from the first trolley and the second trolley comprise a trolly armature, the plurality of rollers, and a pad;

wherein the trolly armature engages the retainer grooves in the frame and the plurality of rollers roll over the planar top surface of the frame;

wherein the individual trolley comprises a tension adjustment knob and a pressure plate;

wherein the pressure plate is pivotably coupled to the trolly armature on an underside of the trolly armature.

2. The beginner burpee exercise machine according to claim 1 wherein the frame is an elongated bar having a longitudinal length that is larger than the lateral width and vertical height;

wherein the two trolleys slidably couple to the frame and move longitudinally along the frame.

3. The beginner burpee exercise machine according to claim 2 wherein the longitudinal length of the frame is 5 feet to 6 feet and the lateral width of the frame are 2 feet or less.

4. The beginner burpee exercise machine according to claim 2 wherein the frame comprises a planar top surface;

wherein the planar top surface is configured for a plurality of rollers located on each of the two trolleys to roll over.

5. The beginner burpee exercise machine according to claim 4 wherein the frame is supported by a plurality of feet;

wherein the plurality of feet lift the frame off of the floor and widen the base of the beginner burpee exercise machine for stability.

6. The beginner burpee exercise machine according to claim 5 wherein the two trolleys comprises a first trolley and a second trolley;

wherein the first trolley and the second trolley are identical.

7. The beginner burpee exercise machine according to claim 6 wherein the trolly armature is an upside-down U-channel that covers the top of the frame and extends down both sides of the frame to the retainer grooves.

8. The beginner burpee exercise machine according to claim 7 wherein the trolly armature comprises a plurality of retention fingers at the bottom of the left side and right side of the trolly armature;

wherein the plurality of retention fingers project inward towards the center of the frame such that the plurality of retention fingers engage the retainer grooves on the frame.

9. The beginner burpee exercise machine according to claim 8 wherein the individual trolley is coupled to the frame by sliding the trolly armature onto the end of the frame while aligning the plurality of retention fingers with the retainer grooves.

10. The beginner burpee exercise machine according to claim 8 wherein the plurality of rollers are coupled to the trolly armature such that the individual trolley rolls over the planar top surface of the frame;

wherein the plurality of rollers are positioned under the top surface of the trolly armature in a space between the planar top surface of the frame and the trolly armature;

wherein the plurality of rollers are rotationally coupled to the inside of the left and right side walls of the trolly armature;

wherein each of the plurality of rollers have an axis of rotation that is laterally oriented and parallel to the planar top surface of the frame.

11. The beginner burpee exercise machine according to claim 10 wherein the pad is coupled to the top of the trolly armature;

wherein the pad is adapted to cushion the top of the individual trolley for the comfort of the user.

12. The beginner burpee exercise machine according to claim 11 wherein the resistance between the frame and the individual trolley is adjustable such that the degree of difficulty required to move the individual trolley is modified.

13. The beginner burpee exercise machine according to claim 12 wherein the tension adjustment knob is operable to pivot the pressure plate around a pivot point.

14. The beginner burpee exercise machine according to claim 13 wherein the tension adjustment knob is turned in a first rotational direction to pivot the pressure plate downwards such that the pressure plate presses against the plurality of rollers to increase resistance to movement;

wherein the tension adjustment knob is turned in a second rotational direction that is opposite the first rotational direction to pivot the pressure plate upwards such that the pressure plate lifts away from the plurality of rollers to decrease resistance to movement.

15. The beginner burpee exercise machine according to claim 14 wherein the beginner burpee exercise machine is adapted for the user to exercise on;

wherein the user's elbows are placed on the pad of the first trolley;

wherein the knees are placed on the pad of the second trolley;

wherein the user assumes a knee elbow position by lifting the user's torso above the pads on the two trolleys using a user's arms and upper legs;

wherein the user assumes a modified prone position by straightening the body such that the distance between the first trolley and the second trolley increases;

wherein the user returns to the knee elbow position by pulling the first trolley and the second trolley together using core muscles.

16. The beginner burpee exercise machine according to claim 15 wherein the first trolley or the second trolley are made immovable by increasing resistance using the tension adjustment knob.

* * * * *